US006858766B2

(12) United States Patent
Dai et al.

(10) Patent No.: US 6,858,766 B2
(45) Date of Patent: Feb. 22, 2005

(54) PROCESS FOR SELECTIVELY HYDROGENATING MIXED PHASE FRONT END $C_2$-$C_{10}$ GREATER UNSATURATED HYDROCARBONS

(76) Inventors: Wei Dai, 14 Beisanhuandong Street, Chaoyang District, Beijing 100013 (CN); Lihua Liao, 14 Beisanhuandong Street, Chaoyang District, Beijing 100013 (CN); Jing Zhu, 14 Beisanhuandong Street, Chaoyang District, Beijing 100013 (CN); Yanlai Guo, 14 Beisanhuandong Street, Chaoyang District, Beijing 100013 (CN); Hui Peng, 14 Beisanhuandong Street, Chaoyang District, Beijing 100013 (CN); Wei Mu, 14 Beisanhuandong Street, Chaoyang District, Beijing 100013 (CN); Shuo Chen, 14 Beisanhuandong Street, Chaoyang District, Beijing 100013 (CN)

( * ) Notice: Subject to any disclaimer, the term of this patent is extended or adjusted under 35 U.S.C. 154(b) by 677 days.

(21) Appl. No.: 09/879,489

(22) Filed: Jun. 13, 2001

(65) Prior Publication Data

US 2002/0004622 A1 Jan. 10, 2002

(30) Foreign Application Priority Data

Jun. 15, 2000 (CN) ..... 00109219 A

(51) Int. Cl.[7] ..... C07C 5/08; C07C 5/04

(52) U.S. Cl. ..... 585/265; 585/254; 585/261; 585/262

(58) Field of Search ..... 585/265, 254, 585/261, 262

(56) References Cited

U.S. PATENT DOCUMENTS 5,414,170 A * 5/1995 McCue et al. ..... 585/264

* cited by examiner

*Primary Examiner*—Thuan D. Dang
(74) *Attorney, Agent, or Firm*—Nath & Associates PLLC; Gary M. Nath; Tanya E. Harkins

(57) ABSTRACT

The present invention provides a process for selectively hydrogenating $C_2$–$C_{10}$ greater unsaturated hydrocarbons (acetylenes and diolefins) at the upstream side of a front depropanizer or front deethanizer in an olefin production plant. After passing through a mixed phase hydrogenation reactor to selectively hydrogenate, the olefin plant process stream passes to a front depropanizer or front deethanizer. The process according to the present invention is able to selectively hydrogenate $C_2$–$C_{10}$ greater unsaturated hydrocarbons (including acetylene), to reduce the number of equipments, the amount of equipment fouling and the energy consumption.

13 Claims, 1 Drawing Sheet

PROCESS FOR SELECTIVELY HYDROGENATING MIXED PHASE FRONT END $C_2$-$C_{10}$ GREATER UNSATURATED HYDROCARBONS

FIELD OF THE INVENTION

The present invention relates to a process for selectively hydrogenating the $C_2$–$C_{10}$ greater unsaturated hydrocarbon components in an olefin production plant.

BACKGROUND OF THE INVENTION

Unless otherwise stated, by "greater unsaturated hydrocarbons" herein we mean the hydrocarbons which contain triple bond and/or two double bonds.

The process for converting hydrocarbons at a high temperature such as steam-cracking or alternatively catalytic cracking, provide unsaturated hydrocarbons such as for example, ethylene, propylene, butadiene, butene; saturated alkanes such as ethane, propane, butane, as well as lighter compounds such as methane, hydrogen and carbon monoxide, and hydrocarbons boiling in the gasoline range. Thus, the gaseous monoolefinic hydrocarbons with two or more carbon atoms, obtained by these processes also contain a considerable amount of hydrocarbons of greater unsaturation degree, i.e. acetylenes and diolefins. In general, the mainly olefin-containing process stream from these processes contains 0.5%–5.3% of acetylenes and diolefins. Acetylenes and diolefins could reduce the activity of the polymerization catalyst and weaken the physical properties of the polymer. Therefore, only after reducing the contents of acetylenes and diolefins below a definite value, can this gaseous monoolefin be used as monomers useful for synthesizing polymers or copolymers.

At present, the economical and simple method commonly adopted in the prior art is converting these greater unsaturated hydrocarbons into the corresponding monoolefins by catalytically selective hydrogenation. The catalytically selective hydrogenation comprises three types: back-end selective hydrogenation, front-end selective hydrogenation and hydrogenation of the cracked gas. The gas from the outlet of the compressor, beside hydrogen, methane, $C_2$ and $C_3$-fractions, also contains $C_4$ fraction (mainly butadiene) and some $C_5$ diolefins. Because of the quick deactivation of the hydrogenation catalyst caused by the polymer formed from diolefin polymerization, and a large portion of the butadiene was lost on the hydrogenation, the process for selectively hydrogenating the cracked gas is scarcely employed industrially.

By "front-end hydrogenation" and "back-end hydrogenation" are meant the location of "acetylenes hydrogenation reactor" relative to "demethanizer", the hydrogenation reactor located in front of the demethanizer means front hydrogenation, and behind that means back-end hydrogenation.

The removal of acetylenes by back-end hydrogenation is that, the top process stream of deethanizer (methane, hydrogen and carbon monoxide) and the carbon mono- and dioxide-free stream out of the methanation reactor (methane and hydrogen) are added respectively and quantitatively into the top process stream of deethanizer ($C_2$ fraction only) to remove the acetylenes by selective hydrogenation. Because of hydrogenation sensitivity to excursions in concentrations of acetylene and carbon monoxide during the acetylene removal, the selectivity of $C_2$ hydrogenation catalyst must be adjusted by carefully regulating the addition of hydrogen and carbon monoxide. Moreover, because of the purity of the ethylene product being influenced by the impurities (such as carbon monoxide, methane etc.) introduced along with the hydrogen, and fluctuated now and then, a rectifying section or a second demethanizer must be installed at the downstream ethylene column, to separate out the remaining hydrogen and methane.

The front-end hydrogenation process for acetylenes removal has been emerged since the fifties of the twentieth century. In recent years, because of the Palladium catalyst with promoter, which has high ethylene-selectivity, small amount of green oil formed and great space velocity, etc., has been successfully developed, the front hydrogenation process for acetylenes removal has been adopted in more and more ethylene plants. There exist two types of front-end hydrogenation process, i.e. front deethanizing front-end hydrogenation process, and front depropanizing front-end hydrogenation process. The former is that before passing into demethanizer, the acetylene is removed by selective hydrogenation of the top stream of the front deethanizer (methane, hydrogen, carbon monoxide and $C_2$); and the latter is that before passing into demethanizer, the acetylene and partial propyne, propadiene are removed by selective hydrogenation of the top stream of the front depropanizer (methane, hydrogen, carbon monoxide, $C_2$ and $C_3$). The disadvantage of the front-end hydrogenation process is that a large amount of hydrogen in the process stream and the fluctuations in the carbon monoxide content, lead to the acetylenes being easy to leak from the outlet or the abnormal operation of the reactor. These abnormal phenomena were due to the temperature excursions caused by the sensitivity and activity of the fresh catalyst at the initial start up of the ethylene production plant. Moreover, the separation of hydrogen and methane is performed in the demethanizer system where the energy consumption is higher, so the higher the content of the hydrogen passes through the demethanizer, the higher the energy consumes.

A process for hydrogenation of acetylene in the mixed phase front end has been disclosed in CN 1098709A (May 12, 1994) hereby incorporated by reference. A mixed phase hydrogenation reactor is adopted in said patent application. Said reactor is located at the downstream side of the front depropanizer and at the upstream side of the further separation units such as demethanizer and deethanizer. The advantages of said patent application is: as concerns the mixed phase hydrogenation of acetylene, the front depropanizer upstream is able to provide liquid stream into the mixed phase hydrogenation reactor, said liquid stream is used to wash and cool said reactor, and able to reduce the number of the front-end hydrogenation units to fully hydrogenate the acetylenes. It has been found that said hydrogenation units are better able to tolerate excursions in carbon monoxide and acetylene concentrations and the abnormal phenomena of the depropanizer.

The disadvantages of said patent application are:

1. Because of the mixed phase hydrogenation reactor being located at the downstream side of the front depropanizer, the cooled and partially condensed stream rich in $C_3$ and lighter components passing through the mixed phase hydrogenation reactor, said process can only hydrogenate the lower unsaturated hydrocarbons, but not be able to hydrogenate the greater unsaturated hydrocarbons such as butyne, butadiene etc, thus the amount of hydrogen consumed is limited and a large amount of remaining hydrogen passes into the cryogenic section where the energy consumption being higher. 2. In said patent application, because of the stream, before passing through the front depropanizer, being not hydrotreated, the alkynes and diolefins in the stream are easy to form equipment fouling, thus increase the energy consumption. 3. When said patent application being employed, a series of units must be attached to perform respectively the additional treatments of the separated $C_3$ and higher components for acetylenes and diolefins removal, so the equipment cost and energy consumption of the production, taken as a whole, would be increased.

Therefore, there needs a process for hydrogenating the greater unsaturated hydrocarbon in the front end of the process stream of the olefin production plant, without the above-mentioned defects of the prior art.

SUMMARY OF THE INVENTION

An object of the present invention is to provide a process for the front-end selectively hydrogenating in an olefin production plant. Without the above-mentioned defects of the prior art, said process is able to selectively hydrogenate the $C_2$–$C_{10}$ greater unsaturated hydrocarbons (including acetylene) in the front end.

DETAILED DESCRIPTION OF THE INVENTION

Figure 1:
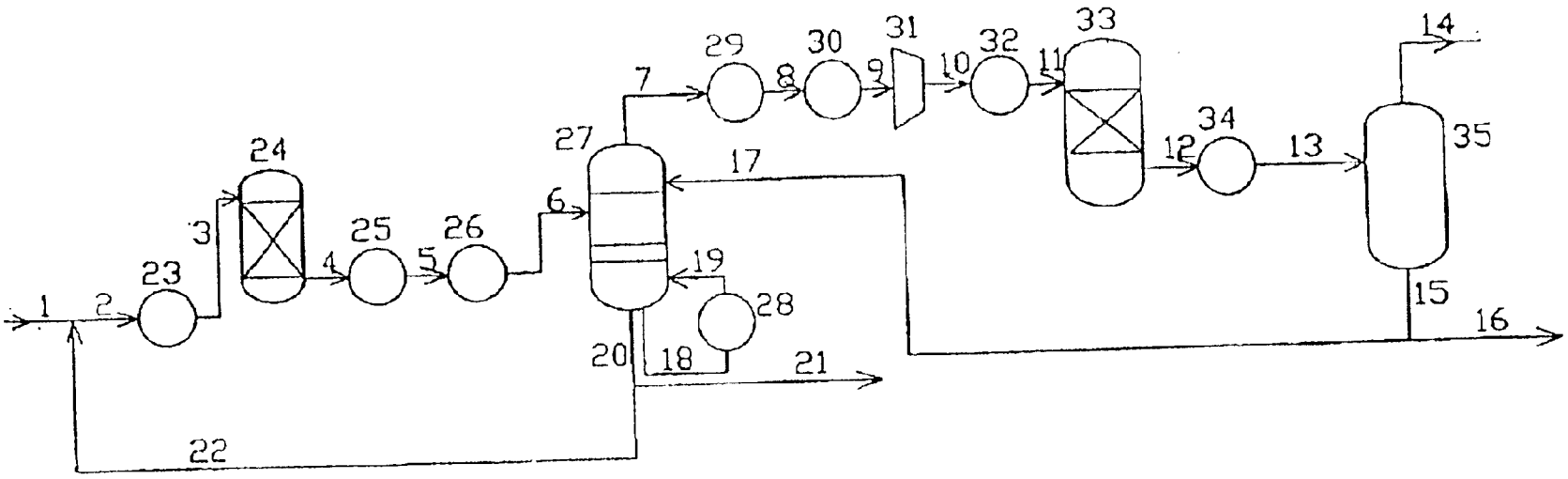
FIG. 1 is a flow diagram of a preferred embodiment of the present invention.

The present invention provides a process for hydrogenating the greater unsaturated hydrocarbon in the process stream of an olefin production plant. More specifically, the present invention contemplates employing a mixed phase hydrogenation reactor which is located upstream of a front depropanizer or a front deethanizer.

Accordingly, the present invention provides a process for treating a feed stream comprising a component selected from the group consisting of hydrogen, carbon monoxide, methane, acetylene, ethylene, ethane, propylene, propane, methylacetylene, propadiene, butene, butane, butyne, butadiene, $C_5$, $C_6$, benzene, toluene, mixture of $C_8$, $C_9$ and $C_{10}$, and mixtures thereof, the process comprising the following steps in sequence:

(1) passing an olefin plant feed stream through a mixed phase hydrogenation reactor [24] to selectively hydrogenate at least a portion of the $C_2$–$C_{10}$ acetylenes and diolefins;

(2) passing the effluent from the mixed phase hydrogenation reactor [24] through a front depropanizer [27] to separate into a vapor stream rich in $C_3$ and lighter components, and a liquid stream rich in $C_4$ and heavier components; or passing the effluent from the mixed phase hydrogenation reactor [24] through a front deethanizer [27] to separate into a vapor stream rich in $C_2$ and lighter components, and a liquid stream rich in $C_3$ and heavier components;

(3) passing the vapor stream from step (2) through a vapor phase hydrogenation reactor [33] to vapor phase hydrogenate, recycling a portion of the $C_4$–$C_{10}$ or $C_3$–$C_{10}$ process stream in the liquid stream from step (2), after mixing with the olefin production plant feed stream, to the mixed phase hydrogenation reactor [24], and the other portion to the downstream separation zone;

(4) passing the effluent from the vapor phase hydrogenation reactor [33] to further separation zones, if any.

In this process, the olefin production plant feed stream can be derived from the product stream of the catalytic cracking unit, or from that of the steam-cracking unit, preferably from the steam-cracking unit. The preferred olefin production plant feed stream comprises hydrogen, methane, carbon monoxide, acetylene, ethylene, ethane, propylene, propane, propyne, propadiene, butene, butyne, 1, 3-butadiene, butane, $C_5$-nonaromatics, $C_6$ nonaromatics, $C_7$ non-aromatics, $C_8$ nonaromatics, benzene, toluene, styrene, mixture of $C_{8\text{-}10}$ fractions, or mixtures thereof.

The front depropanizer [27] or the front deethanizer [27] operates at a pressure ranging from about 0.5 MPa to 4.0 MPa.

The mixed phase hydrogenation reactor operates at a temperature of from about 10° C. to 90° C., and a pressure of from about 0.7 MPa to 4.0 MPa, in the presence of a mixed phase hydrogenation catalyst containing Group VIII metal or Group IB metal. The mixed phase hydrogenation catalyst can comprise, for example, one or more components selected from Palladium, Ruthenium, Platinum, Nickel arsenide, are carried on a support. The support can be selected from titanium oxide, silicon oxide, aluminum oxide, zinc oxide, tin oxide, molecular sieve, or mixtures thereof.

These catalysts can contain a promotor. The promotor can be Potassium, Sodium, Lithium, Calcium, Magnesium, Barium, Copper, Silver, Gold, Zinc, Lanthanum, Cerium, Molybdenum, Tungsten, Antimony, Arsenic, Bismuth, Vanadium, or mixtures thereof.

Recycles a portion of said liquid stream from step (2) to the mixed phase hydrogenation reactor [24], and the other portion to a debutanizer or depropanizer.

The further separation zones comprise the separation zones of demethanizer, deethanizer and the removing means for methane, ethane, and mixtures thereof.

The vapor phase hydrogenation reactor [33] operates at a temperature of from about 30° C. to 200° C., and a pressure of from about 0.6 MPa to 4.0 MPa, in the presence of a Group VIII metal-containing hydrogenation catalyst. For example, one or more components selected from Palladium, Ruthenium, Platinum, Nickel arsenide, are carried on a support. The support is selected from titanium oxide, silicon oxide, aluminum oxide, zinc oxide, tin oxide, molecular sieve, or mixtures thereof.

These catalysts can also contain the promotor. The promotor can be Potassium, Sodium, Lithium, Calcium, Magnesium, Barium, Copper, Silver, Gold, Zinc, Lanthanum, Cerium, Molybdenum, Tungsten, Antimony, Arsenic, Bismuth, Vanadium, or mixtures thereof.

A preferred process of the present invention for selectively hydrogenating the $C_2$–$C_{10}$ greater unsaturated hydrocarbon in an olefin production plant comprising the steps of, in sequence.

a. passing an olefin-containing feed stream through a heat exchanger [23], to cool said feed stream to 10–90° C.;

b. passing the process stream from step (a) through the mixed phase hydrogenation reactor [24];

c. Selectively hydrogenating at least a portion of the greater unsaturated hydrocarbons such as acetylene, propyne, propadiene, butyne, butadiene and $C_5$ and heavier diolefins in the process stream entering the mixed phase hydrogenation reactor [24];

d. passing the effluent from the mixed phase hydrogenation reactor [24] in step [c], through a cooler to cool said effluent;

e. passing the cooled process stream through the front depropanizer [27], to separate into a vapor stream rich in $C_3$ and lighter components, and a liquid stream rich in $C_4$ and heavier components such as $C_4$–$C_{10}$, the front depropanizer [27] operates at a pressure ranging from about 0.5 MPa to about 2.0 MPa; or passing the cooled process stream through the front deethanizer [27], to separate into a vapor stream rich in $C_2$ and lighter components, and a liquid stream rich in $C_3$ and heavier components such as $C_3$–$C_{10}$, the front deethanizer [27] operates at a pressure ranging from about 2.5 MPa to about 4.0 MPa.

f. passing the vapor phase rich in $C_3$ and lighter components through the vapor phase hydrogenation reactor [33], to selectively hydrogenate all the residual acetylene, propyne, propadiene; or passing the vapor phase rich in $C_2$ and lighter components through the vapor phase hydrogenation reactor [33], to selectively hydrogenate the residual acetylene; recycling a portion of the liquid stream, after mixing with the olefin-containing feed-stream from the cracking plant, to a mixed phase hydrogenation reactor [24], the other portion to a debutanizer or depropanizer;

g. cooling and partially condensing the vapor phase process stream from the vapor phase hydrogenation reactor [33], and recycling the condensed process stream as reflux liquid to the top of the front depropanizer [27] or front deethanizer [27];

h. passing the vapor phase stream from step (g) to the downstream separation zones for the removal of methane, ethane, or mixtures thereof.

Any catalyst well known in the art of selective hydrogenation can be employed in the mixed phase or vapor phase hydrogenation reactors of the present invention. The Group VIII metal hydrogenation catalyst is the most commonly used and presently preferred. The Group VIII metal hydrogenation catalyst is generally includes a support such as alumina. A kind of catalyst that has been used successfully contains about 0.1 wt. %–about 1 wt. % of Group VIII metal impregnated, by the total weight of the catalyst. These and other catalysts are more fully disclosed in some literatures. The examples disclosed in the prior art are: as concerns the support, most of selectively hydrogenation catalysts for acetylenes and diolefins are the alumina-supported Palladium catalysts, see U.S. Pat. No. 3,679,762 and U.S. Pat. No. 4,762,956; titanium oxide-supported Palladium catalyst in U.S. Pat. No. 4,839,329; silicon oxide-supported palladium-Zinc catalyst in DE-A 2,156,544; calcium carbonate-supported Palladium-Lead catalyst; and cellular iolite (containing alkali metal and/or alkali-earth metal)-supported Palladium catalyst in CN 1176291A. As concerns the active component of the catalyst in the prior art, also included are palladium catalyst with the addition of a promotor: the promotor disclosed in U.S. Pat. No. 4,404,124 is silver; that in EP-A 892252 is Gold; that in DE-A 1,284,403 and U.S. Pat. No. 4,577,047 is chromium; that in U.S. Pat. No. 3,912,789 is copper; that in U.S. Pat. No. 3,900,526 is iron; that in U.S. Pat. No. 3,489,809 is Rhodium; that in U.S. Pat. No. 3,325,556 is lithium; and that in CN 1151908A is Potassium. Furthermore, also disclosed are the compositions and processes for acetylenes and diolefins selective hydrogenation catalyst in U.S. Pat. No. 4,571,442; U.S. Pat. No. 4,347,392; U.S. Pat. No. 4,128,595; U.S. Pat. No. 5,059,732 and U.S. Pat. No. 5,414,170.

All of the above-mentioned patents, patent applications and publications are hereby incorporated by reference.

According to the present invention, the hydrotreating conditions employed in the mixed phase or vapor phase hydrogenation reactors, may be changed appropriately depending on different compositions of the process stream being treated. In general, the temperature and pressure are controlled sufficiently to completely hydrogenate substantially all of the greater unsaturated hydrocarbons contained in the process stream fed into the vapor phase hydrogenating reactor. Ordinarily, the hydrotreating process operates at a temperature within a range of 10° C. to 90° C. and a pressure within a range of 0.7 to 4.0 MPa. The hydrogen flow, during the hydrogenation, is at least sufficient to meet the stoichiometric requirements for converting the greater unsaturated hydrocarbons to the monoolefin, and generally, is in the range of about 1 to 100 moles of hydrogen/mol of greater unsaturated hydrocarbons. The process can be conducted by employing the catalyst in a fixed bed or other type of contacting means known to those skilled in the art.

From the above description of the present invention, those skilled in the art may find variations and adaptations thereof. For example, any of the know hydrogenation catalysts can be employed. Further, the reactor can be of the fixed bed type or other configurations useful in the hydrogenation of acetylenes.

In another embodiment of the present invention, the low pressure (0.6–1.8 MPa) vapor phase hydrogenation reaction is carried out without the compression of the top vapor phase stream of the front depropanizer, thus the compressor [31] can be eliminated.

According to the technical solution of the present invention, the device [27] may be the front depropanizer or the front deethanizer. It belongs to the front depropanizing separation flow route in case of the front depropanizer, and to the front deethanizing separation flow route in case of the front deethanizer.

Surprisingly, the present inventors have found that by installing a mixed phase hydrogenation reactor at the upstream side of the front depropanizer or the front deethanizer, and recycling the liquid process stream from the front depropanizer or the front deethanizer to the mixed phase hydrogenation reactor, not only the advantage of washing and cooling the mixed phase hydrogenation reactor with the liquid derived from the front depropanizer or the deethanizer in the prior art can be maintained, but also greatly extending the hydrogenation range to selectively hydrogenate the $C_2$–$C_{10}$ greater unsaturated hydrocarbon including acetylene.

Moreover, the present inventors have unexpectedly found that due to a large amount of the greater unsaturated hydrocarbons having been removed from the process stream before passing through the front depropanizer or front deethanizer, the amount of equipment fouling and the energy consumption can be reduced. Meanwhile, due to a large amount of hydrogen having been consumed in the prehydrogenation, the load of the four-stage compressor and the energy consumption of the demethanizer can be reduced correspondingly as well, and the temperature and pressure of the hydrogenation reactor can also be reduced.

In the present invention, the liquid process stream from the front depropanizer bottom (mainly $C_4$, $C_5$ fractions and some $C_6$ and heavier fractions of cracked gasoline) or that from the front deethanizer bottom (mainly $C_3$, $C_4$, $C_5$ fractions and some $C_6$ and heavier fractions of cracked gasoline) is recycled to the mixed phase hydrogenation reactor, providing the liquid washing and cooling effect; the liquid phase $C_3$, $C_4$ and $C_5$ fractions partially vaporizes at the condition of the mixed phase reaction, a large amount of reaction heat is removed; the reactor can simulate an isothermal reactor, providing improved selectivity and safety of hydrogenation and improved service life of the catalyst.

The number of hydrogenation units for fully hydrogenating the acetylene can be reduced by the present invention.

The content of hydrogen entering the cryogenic portion can be reduced, and the energy consumption and the size of the cryogenic portion units can be cut down as well by the present invention.

The content of diolefin entering the front depropanizer or front deethanizer can be reduced, and the energy consumption and the amount of the equipment fouling can be cut down as well by the present invention.

EXAMPLE 1

Referring to FIG. 1, a vapor phase olefin-containing feed stream from a steam pyrolysis facility in line 1 was mixed in line 2 with the liquid stream from the bottom of the front depropanizer in line 22, then heat exchanged in heat exchanger 23, and fed through line 3 into mixed phase hydrogenation reactor 24. The mixed phase hydrogenation reactor 24 operated at a relatively low temperature range (about 30°–80° C.) and relatively moderate pressure range (about 1.0–2.0 MPa), in the presence of BC-L-8A hydrogenation catalyst (Pd content 0.28 wt %, Ag content 0.48 wt. %, $Al_2O_3$ as the support, manufactured by Beijing Research Institute of Chemical Industry, China Petrochemical Corp.). The reaction product from the mixed phase hydrogenation reactor was cooled through cooler 25 and cooler 26, passed into a front depropanizer 27, and separated into a liquid stream and a vapor stream. A portion of the liquid phase stream rich in $C_4$ components from the front depropanizer 27, through line 22 recycled to the upstream of the mixed phase hydrogenation reactor, the other portion through line 21 passed into the debutanizer. The vapor phase separated from the front depropanizer was withdrawn from line 7, heated in heat exchangers 29, 30, then directed through line 9 to compressor 31. The vapor effluent from the compressor 31 passed through line 10 into cooler 32. The cooled vapor phase passed through line 11 into vapor phase hydrogenation reactor 33. The vapor phase hydrogenation catalyst was BC-H-22A (Pd content 0.03 wt. %, Ag content, 0.12 wt. %, $Al_2O_3$ as the supporter, manufactured by Beijing Research Institute of Chemical Industry, China Petrochemical Corp.), the temperature and pressure of the vapor phase hydrogenation reactor 33 were sufficient to complete the hydrogenation of substantially all of the acetylenes contained in the stream fed to the vapor phase hydrogenation reactor. Generally, the hydrogenation temperature is 30°C.–200° C., hydrogenation pressure is 1.0–4.0 MPa. The effluent from the vapor phase hydrogenation reactor passed through line 12 into heat exchanger 34 to cool, the resulting gas-liquid stream was separated into gas stream and liquid stream in separator 35, recycled a portion of the liquid stream as a reflux liquid of the front depropanizer through line 17 to the top of the front depropanizer, passed the other portion of the liquid stream through line 16, the vapor phase through line 14 into a demethanizer and/or deethanizer at the downstream of the cooler, and other separation units for further separating the other components.

EXAMPLE 2

The present invention also contemplated the case of low-pressure (0.6–1.8 MPa) vapor phase hydrogenation without the compression of the top vapor phase stream of the front depropanizer. Referring to FIG. 1, the mixed phase and vapor phase hydrogenation catalysts used are the same as those in example 1.

EXAMPLE 3

The present inventors also contemplated the case of the combination of cracked gas prehydrogenation and front deethanizing separation. In this process, recycling the front deethanizer bottom liquid feed stream (containing mainly the components: $C_3$, $C_4$, $C_5$ fractions and some $C_6$ and heavier fractions of cracked gasoline) to the mixed phase hydrogenation reactor, providing the liquid washing and cooling effect, the liquid phase $C_3$, $C_4$ and $C_5$ fractions were partially vaporized at the mixed phase reaction condition, and thus a large amount of reaction heat was removed, and the safety of hydrogenation and the service life of the catalyst were improved accordingly. Referring to FIG. 1. In line 1, the cracked gas from the steam-cracking unit was mixed in line 2 with the front deethanizer liquid stream from line 22, passed into a mixed phase hydrogenation reactor 24, and a large portion of acetylenes and diolefins in the $C_2$–$C_{10}$ fractions was converted into the corresponding olefins in said reactor. The reaction product from the mixed phase hydrogenation reactor, was passed through cooler 25 into front deethanizer 27, and the cooled reaction product was then separated into a liquid stream and a vapor stream. A portion of the liquid phase rich in $C_3^+$- and higher fractions components, separated from the front deethanizer, recycled to the upstream of the mixed phase hydrogenation reactor through the line 22, the other portion passed through line 21 to the depropanizer. The vapor phase from the front deethanizer top is withdrawn through line 7, heat exchanged in heat exchanger 29, then passed through a vapor phase hydrogenation reactor 33, converted the residual acetylenes completely. The effluent from the vapor phase hydrogenation reactor passes through line 13 to heat exchanger 32 to cool, then to the downstream separation unit. The mixed phase and the vapor phase hydrogenation catalysts used are the same as those in example 1.

What is claimed is:

1. A process for selectively hydrogenating $C_2$–$C_{10}$ acetylenes and diolefins in an olefin production plant comprising the steps of, in sequence (1) passing an olefin plant feed stream through a mixed phase hydrogenation reactor [24] to mixed phase-hydrogenate at least a portion of the $C_2$–$C_{10}$ acetylenes and diolefins;

(2) passing the effluent from the mixed phase hydrogenation reactor [24] through a front depropanizer [27] to separate into a vapor stream rich in $C_3$ and lighter components and a liquid stream rich in $C_4$ and heavier components; or passing the effluent from the mixed phase hydrogenation reactor [24] through a front deethanizer [27] to separate into a vapor stream rich in $C_2$ and lighter components and a liquid stream rich in $C_3$ and heavier components;

(3) passing the vapor stream from step (2) through the vapor phase hydrogenation reactor [33] to vapor phase hydrogenate; recycling a portion of a $C_4$–$C_{10}$ process stream to the mixed phase hydrogenation reactor [24], and passing the other portion to the downstream separation zones; and (4) passing the effluent from the vapor phase hydrogenation reactor [33] to further separation zones.

2. A process as claimed in claim 1, wherein said olefin plant feed stream is derived from a process stream of a steam pyrolysis facility or a catalytic cracking facility.

3. A process as claimed in claim 1, wherein said olefin plant feed stream comprises a component selected from the group consisting of hydrogen, methane, carbon monoxide, acetylene, ethylene, ethane, propylene, propane, propyne, propadiene, butene, butyne, 1,3-butadiene, butane, $C_5$ nonaromatics, $C_6$ nonaromatics, $C_7$ nonaromatics, $C_8$ nonaromatics, benzene, toluene, styrene, and mixtures thereof.

4. A process as claimed in claim 1, wherein said front depropanizer [27] or front deethanizer [27] operates at a pressure ranging from 0.5 MPa to 4.0 MPa.

5. A process as claimed in claim 1, wherein said mixed phase hydrogenation reactor operates at a temperature from 10° C. to 90° C. and a pressure of from 0.7 MPa to 4.0 MPa, in the presence of a mixed phase hydrogenation catalyst comprising Group VIII metal or Group IB metal.

6. A process as claimed in claim 5, wherein said mixed phase hydrogenation catalyst comprises one or more components selected from the group consisting of Palladium, Ruthenium, Platinum, and Nickel arsenide that is carried on a support and the support is selected from the group consisting of titanium oxide, silicon oxide, aluminum oxide, zinc oxide, tin oxide, molecular sieve, and mixtures thereof.

7. A process as claimed in claim 6, wherein said mixed phase hydrogenation catalyst also includes a promotor selected from the group consisting of potassium, sodium, lithium, calcium, magnesium, barium, copper, silver, gold, zinc, lanthanum, cerium, molybdenum, tungsten, antimony, arsenic, bismuth, vanadium, and the mixtures thereof.

8. A process as claimed in claim 1, characterized in that recycling a portion of the liquid stream of step (2) to the mixed phase hydrogenation reactor [24], and passing the other portion to debutanizer or depropanizer.

9. A process as claimed in claim 1, wherein said vapor phase hydrogenation reactor operates at a temperature from 30° C. to 200° C. and a pressure of from 0.6 MPa to 4.0 MPa, in the presence of a Group VIII metal-containing hydrogenation catalyst.

10. A process as claimed in claim 9, wherein said vapor phase hydrogenation catalyst contains one or more components selected from the group consisting of palladium, ruthenium, platinum and nickel arsenide that is carried on a support and the support is selected from the group consisting of titanium oxide, silicon oxide, aluminum oxide, zinc oxide, tin oxide, molecular sieve and the mixtures thereof.

11. A process as claimed in claim 1, wherein said vapor phase hydrogenation catalyst further includes a promotor selected from the group consisting of potassium, sodium, lithium, calcium, magnesium, barium, copper, silver, gold, zinc, lanthanum, cerium, molybdenum, tungsten, antimony, arsenic, bismuth, vanadium, and the mixtures thereof.

12. A process as claimed in claim 1, wherein said further separation zones include demethanizer, deethanizer and the separation zone of the mixtures thereof.

13. A process for selectively hydrogenating $C_2$–$C_{10}$ greater unsaturated hydrocarbons in an olefin production plant comprising the following steps:

a. passing an olefin-containing feed stream through a heat exchanger [23], to cool said feed stream to 10–90° C.;

b. passing the process stream from step (a) through the mixed phase hydrogenation reactor [24];

c. Selectively hydrogenating at least a portion of the greater unsaturated hydrocarbons in the process stream entering the mixed phase hydrogenation reactor [24];

d. passing the effluent from the mixed phase hydrogenation reactor [24] in step [c], through coolers [25], [26] to cool said effluent;

e. passing the cooled process stream through the front depropanizer [27], to separate into a vapor stream rich in $C_3$ and lighter components, and a liquid stream rich in $C_4$ and heavier components, front depropanizer [27] operating at a pressure ranging from 0.5 MPa to 2.0 MPa; or passing the cooled process stream through front deethanizer [27], to separate into a vapor stream rich in $C_2$ and lighter components, and a liquid stream rich in $C_3$ and heavier components, the front deethanizer [27] operating at a pressure ranging from 2.5 MPa to 4.0 MPa;

f. passing the vapor phase rich in $C_3$ and lighter components through the vapor phase hydrogenation reactor [33], to selectively hydrogenate all the residual acetylene, propyne, propadiene; or passing the vapor phase rich in $C_2$ and lighter components through the vapor phase hydrogenation reactor [33], to selectively hydrogenate the residual acetylene; recycling a portion of the liquid stream to mixed phase hydrogenation reactor [24], the other portion to debutanizer or depropanizer;

g. cooling and partially condensing the vapor phase process stream from the vapor phase hydrogenation reactor, and recycling the condensed process stream as reflux liquid to the top of the front depropanizer [27] or the front deethanizer [27];

h. passing the vapor phase stream from step (g) to the downstream separation zones for the removal of methane, ethane, or the mixtures thereof.

* * * * *